US008967616B2

(12) United States Patent
Sugitani et al.

(10) Patent No.: US 8,967,616 B2
(45) Date of Patent: Mar. 3, 2015

(54) SHEET EJECTION DEVICE

(71) Applicant: Riso Kagaku Corporation, Tokyo (JP)

(72) Inventors: Hiroshi Sugitani, Ibaraki (JP); Tomohiko Shimoda, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/010,885

(22) Filed: Aug. 27, 2013

(65) Prior Publication Data

US 2014/0062004 A1 Mar. 6, 2014

(30) Foreign Application Priority Data

Aug. 31, 2012 (JP) ..... 2012-191107

(51) Int. Cl.

| | |
|---|---|
| ***B65H 31/20*** | (2006.01) |
| ***B65H 31/34*** | (2006.01) |
| ***B65H 29/70*** | (2006.01) |
| ***B65H 31/10*** | (2006.01) |
| ***B65H 33/08*** | (2006.01) |
| ***B65H 39/10*** | (2006.01) |
| ***B65H 29/52*** | (2006.01) |

(52) U.S. Cl.

CPC ..... *B65H 31/34* (2013.01); *B65H 29/70* (2013.01); *B65H 31/10* (2013.01); *B65H 33/08* (2013.01); *B65H 39/10* (2013.01); *B65H 29/52* (2013.01); *B65H 2301/42194* (2013.01); *B65H 2301/51214* (2013.01); *B65H 2404/742* (2013.01); *B65H 2405/1115* (2013.01); *B65H 2405/1122* (2013.01); *B65H 2405/1134* (2013.01); *B65H 2405/1142* (2013.01); *B65H 2405/15* (2013.01); *B65H 2601/273* (2013.01); *B65H 2801/06* (2013.01); *B65H 2801/15* (2013.01); *B65H 2801/18* (2013.01); *B65H 2404/5131* (2013.01)

USPC ..... 271/223; 271/221

(58) Field of Classification Search

CPC ..... B65H 31/10; B65H 31/34; B65H 31/38; B65H 31/26

USPC ..... 271/217, 220, 221, 171

See application file for complete search history.

(56) References Cited

U.S. PATENT DOCUMENTS

| | | | | |
|---|---|---|---|---|
| 6,494,450 | B2 * | 12/2002 | Tsurumaki | 271/224 |
| 6,991,229 | B2 * | 1/2006 | Yamakawa et al. | 271/223 |
| 8,041,283 | B2 * | 10/2011 | Murai | 399/367 |
| 8,091,882 | B2 * | 1/2012 | Iguchi et al. | 270/58.17 |

FOREIGN PATENT DOCUMENTS

| | | |
|---|---|---|
| JP | 10-109808 | 4/1998 |

* cited by examiner

*Primary Examiner* — Michael McCullough

(74) *Attorney, Agent, or Firm* — Hamre, Schumann, Mueller & Larson, P.C.

(57) ABSTRACT

A sheet ejection device includes a sheet tray on which ejected sheets are stacked, a pair of side fences for restricting positions of the ejected sheets along a lateral direction perpendicular to an ejection direction, and at least one rib is formed vertically on each inner side of the side fences. The ribs are configured to contact with side edges of each of the ejected sheets while the each of the ejected sheets falls down to the sheet tray to align the ejected sheet along the lateral direction. The ejected sheets are aligned adequately by the ribs. According to the sheet ejection device, superior sheet ejection performance can be brought without affected by its environment.

11 Claims, 9 Drawing Sheets

(+)OS
(-)OS
SL
EL
H
P
10
2
3
21
21b
21e
29
52
53
82
97

SHEET EJECTION DEVICE

BACKGROUND OF THE INVENTION

1. Technical Field

The present invention relates to a sheet ejection device that stacks sheets and divides the sheets into plural sets while stacking by setting the sheets off alternately (forward and backward) along an ejection direction of the sheets.

2. Background Arts

Recently, a great large number of print sheets are used for printing and copying in printers (such as inkjet printers, stencil printers and laser printers) and copiers. A Japanese Patent Application Laid-Open No. H10-109808 discloses a sheet ejection device used in such printers and copiers. According to the disclosed sheet ejection device, a large number of sheets can be stacked orderly and uniformly.

The sheet ejection device, although it is not shown by drawings, includes a bottom plate, an end plate, a pair of side fences extending along a sheet ejection direction and faced to each other, fins provided on the side fences, respectively, and guide members swingably provided on the side fences vertically, respectively, in order to stack a large number of sheets orderly.

SUMMARY OF THE INVENTION

A condition of sheets to be ejected varies due to a change of their environment, and thereby dropping behaviors of ejected sheets may become unstable. Therefore, the ejected sheers may be damaged when ejected, and stacking alignment of the ejected sheets may degrade.

Specifically, in a case of sheets having a light bias weight and a small size (e.g. bias weight: 60 g/m$^2$ or less and size: B5) under a hot and humid condition (e.g. temperature: 30° C. and humidity: 70% or less), contact frictions with the side fences become large while the sheets are dropping off and balancing between both side edges of the sheets becomes hard to be kept well. Therefore, the sheets may lean on one of the side fences, and thereby the damages of sheets and the degradation of stacking alignment may easily occur.

On the other hand, in a case of sheets having a light bias weight and a small size (e.g. bias weight: 60 g/m$^2$ or less and size: B5) under a cold and dry condition (e.g. temperature: 10° C. and humidity: 40% or less), contact frictions with the side fences become large while the sheets are dropping off and contact areas between dropping sheets and the side fences are large, so that the sheets may be drawn to one of the side fences due to electrostatic charge (e.g. almost 10 kV) of the dropping sheet. Therefore, the sheets may lean on the side fence, and thereby the damages of sheets and the degradation of stacking alignment may easily occur.

An object of the present invention is to provide a sheet ejection device that can provide superior sheet ejection performance without affected by its environment.

An aspect of the present invention provides a sheet ejection device that includes a sheet tray on which ejected sheets are stacked; a pair of side fences for restricting positions of the ejected sheets along a lateral direction perpendicular to an ejection direction; and at least one rib is formed vertically on each inner side of the side fences, wherein the ribs are configured to contact with side edges of each of the ejected sheets while the each of the ejected sheets falls down to the sheet tray to align the ejected sheet along the lateral direction.

According to the above aspect, both side edges of each of the ejected sheets contact with the ribs on the side fences while the each of the ejected sheets falls down to the sheet tray, and thereby the each of the ejected sheet can be aligned along the lateral direction. Therefore, an attitude of the each of the ejected sheets can be corrected adequately by the ribs, and then stacked on the sheet tray after its lateral position is aligned correctly. As a result, superior sheet ejection performance can be provided without affected its environment such as humidity. In addition, a drop speed of each of the ejected sheets contacting with the ribs becomes faster that contacting with both inner surfaces of the side fences. Therefore, the number of ejection sheets per unit time can be made larger because the next sheet ejection can be done earlier.

DESCRIPTION OF THE EMBODIMENTS

Figure 1:
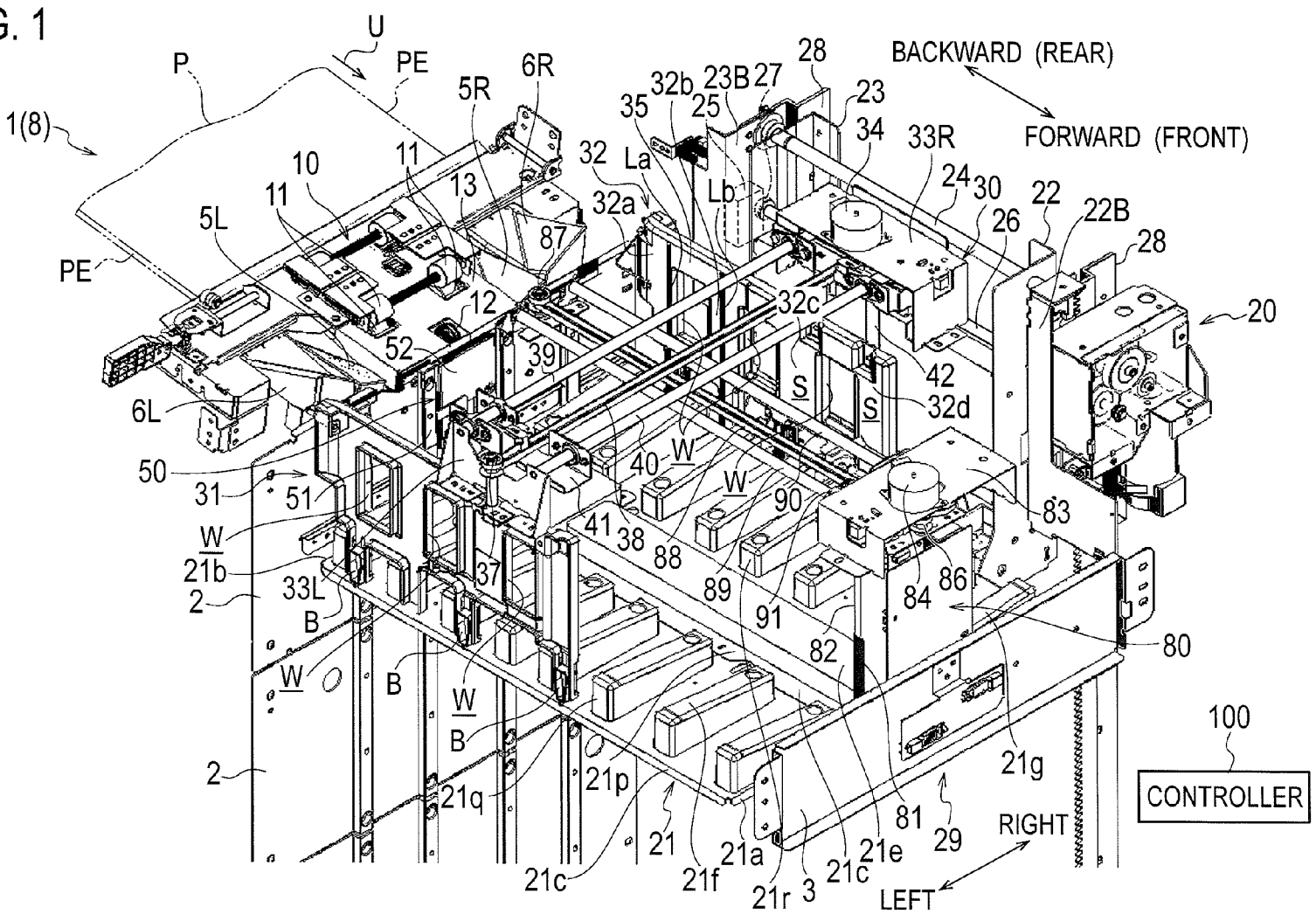
FIG. 1 is a perspective view showing a sheet ejection device according to an embodiment.

Hereinafter, an embodiment will be explained with reference to the drawings. In the drawings, an identical or equivalent component is indicated by an identical reference number. Note that the drawings show components schematically, and it should be considered that the components in the drawings are not shown precisely as they are. In addition, actual dimensions of the components and actual dimensional proportions among the components may be shown differently in the drawings.

Further, the embodiment described below is explained as an example that specifically carries out the subject matter of the present invention. In addition, materials, shapes, structures, arrangements of the components are not limited to those in the embodiment. The embodiment may be modified within the scope of the claims (e.g. arrangement of the components may be changed from the embodiment).

Furthermore, the sheet ejection device can adapt to any size of sheets. Although sheets are printed by stencil printing or by inkjets in the following descriptions, they can be printed by other methods. A printing method is not limited.

In the following descriptions, "right" and "left" are used based on a viewpoint from a downstream side of a sheet ejection direction U (i.e. viewed counter to a sheet ejection flow), as indicated in FIG. 1. Similarly, "forward (front)" and "backward (rear)" are used in relation to forward (front side) or backward (rear side) along the sheet ejection flow, as indicated in FIG. 1.

Figure 2:
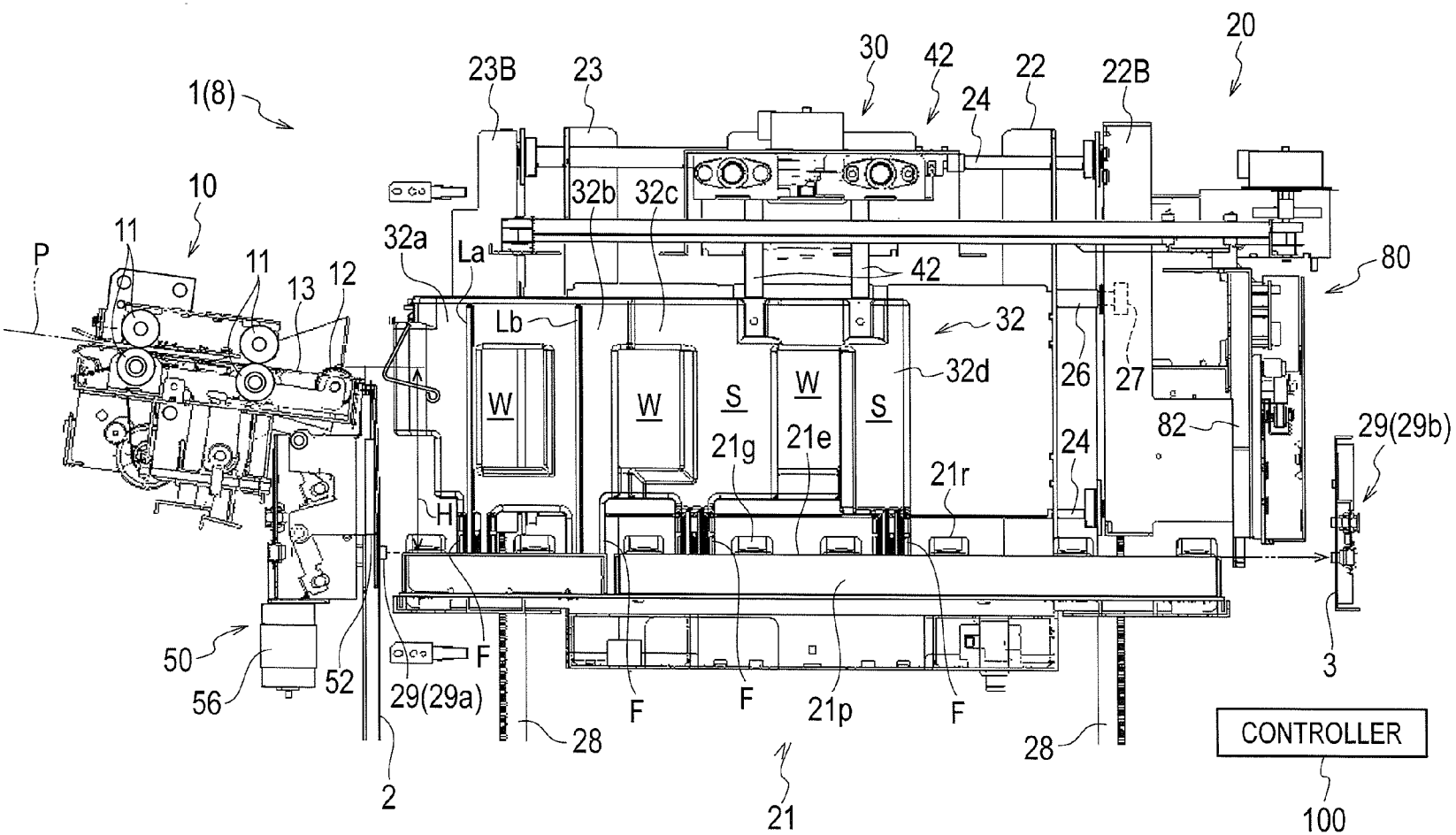
FIG. 2 is a cross-sectional side view showing the sheet ejection device.

FIGS. 1 and 2 show a main portion (a sheet set dividing unit 1) in a sheet ejection device 8 according to the present embodiment. The sheet ejection device 8 can be applied to a printer such as an inkjet printer, a stencil printer and a laser printer, and to an image forming apparatus that forms images on a sheet P by using a copier or the like. In the present embodiment, the sheet ejection device 8 is disposed on a sheet ejection side of an image forming apparatus (not shown).

The sheet set dividing unit 1 in the sheet ejection device 8 includes an ejection unit 10, a tray elevating mechanism 20, a pair of laterally-restricting plates (side fences) 31 and 32 for laterally restricting the sheets P stacked on a sheet tray 21, and a laterally-restricting plate shifting mechanism (side fence shifting mechanism) 30. The ejection unit 10 sequentially ejects sheets P supplied from the image forming apparatus along the sheet ejection direction U. The tray elevating mechanism 20 receives the sheets P that are sequentially ejected and then dropped off onto a sheet tray 21 to stack the ejected sheets P on the sheet tray 21, and shifts the sheet tray 21 vertically according to the number of the sheets P stacked on the sheet tray 21. The laterally-restricting plate shifting mechanism 30 shifts the laterally-restricting plates 31 and 32 along a lateral direction perpendicular to the sheet ejection direction U according to a size (lateral width) of the ejected sheets P. The sheet set dividing unit 1 further includes an offset guide plate shifting mechanism 50 and an end plate shifting mechanism 80.

The offset guide plate shifting mechanism 50 shifts an offset guide plate (guide fence) 52 and a first sheet aligning plate 53 (see FIGS. 4A and 4B) forward-and-lower or backward-and-upper by a predetermined offset OS (see FIGS. 9C and 9H) for dividing each sheet set. According to this configuration, when dividing the sheets P, trailing edges of the sheets P stacked on the sheet tray 21 can be set off by the offset guide plate 52 provided vertically on a first bracket 51 at an upstream side of the sheet tray 21 and at a height level higher than an upper surface 21*e* of the sheet tray 21.

Figure 6:
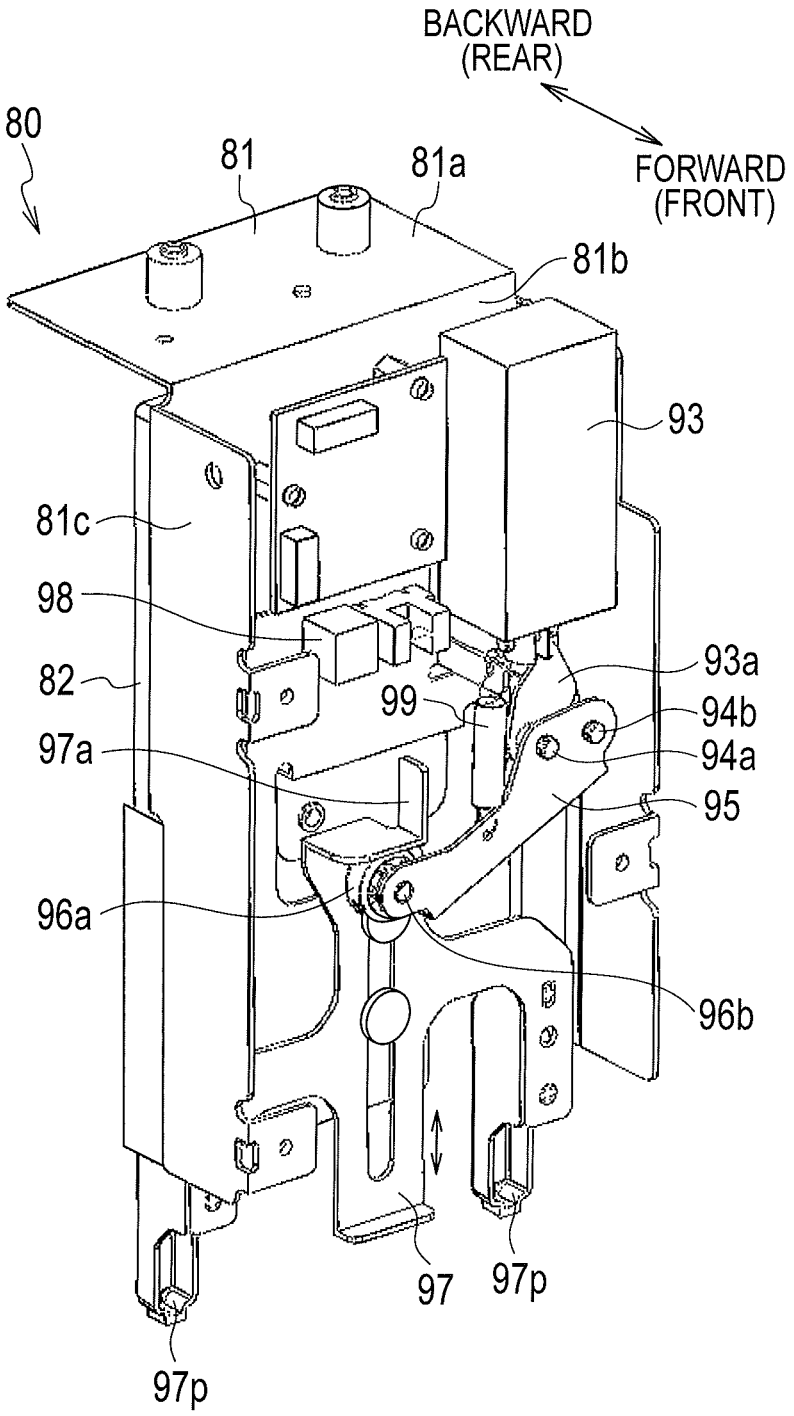
FIG. 6 is an enlarged cross-sectional view showing an end plate shifting mechanism in the sheet ejection device.

The end plate shifting mechanism 80 shifts an end plate (end fence) 82 and a second sheet aligning plate 97 (see FIG. 6) forward or backward by the offset OS (see FIGS. 9E and 9H) for dividing each sheet set, and lifts the second sheet aligning plate 97 up by using an electromagnetic solenoid (upward shifting mechanism) 93 (see FIG. 6). When the end plate 82 reaches its offset position, the second sheet aligning plate 97 is weighed down with its own weight. According to this configuration, when dividing the sheets P, leading edges of the sheets P stacked on the sheet tray 21 can be set off by the end plate 82 provided vertically on a second bracket 81 at a downstream side of the sheet tray 21 and at a height level higher than the upper surface 21*e* of the sheet tray 21.

In addition, the sheet ejection device 8 further includes a controller 100 for controlling the above-explained components. An installation position of the controller 100 is not limited. The controller 100 may be provided integrally with a controller of the image forming apparatus, or may be provided integrally with a controller that controls an entire of the sheet ejection device 8. Further, the controller 100 may be disposed at an arbitrary position in the sheet set dividing unit 1.

Here, the sheet tray 21 can be shifted vertically while keeping its horizontal attitude, and the sheets P stacked on the sheet tray 21 are divided into plural sets (staggered forwardly and backwardly) by the offset guide plate 52 (that restricts the trailing edges of the sheets P), the end plate 82 (that restricts the leading edges of the sheets P) and the pair of laterally-restricting plates 31 and 32 (that restricts the sheets P laterally). Namely, the sheets P stacked on the sheet tray 21 are divided into plural sets (staggered alternately forward and backward) while they are surrounded by these four plates 31, 32, 52 and 82. The plates 31, 32, 52 and 82 are provided separately (independently) from the sheet tray 21.

(Ejection Unit 10)

The ejection unit 10 is attached to an upper portion of an uppermost rear panel 2 of the sheet set dividing unit 1. In the ejection unit 10, two pairs of sheet feed rollers 11 and an ejection roller 12 are provided along a sheet guide plate 13. The two pairs of sheet feed rollers 11 sequentially feed the sheets P supplied from the image forming apparatus. The ejection roller 12 is disposed at a sheet ejection position.

In addition, a pair of first wing members 5L and 5R and a pair of second wing members 6L and 6R are provided on both sides of the sheet guide plate 13, respectively. The first wing members 5L and 5R are made of metal, and each of their downstream end faces has an almost triangle shape. The first wing members 5L and 5R are disposed symmetrically with respect to a central line (along the sheet ejection direction U) of the sheet guide plate 13. The second wing members 6L and 6R are also made of metal, and each of their downstream end faces has an almost trapezoidal shape. The second wing members 6L and 6R are also disposed symmetrically with respect to the central line of the sheet guide plate 13.

An upper face of the first wing member 5L (5R) is made inclined to form a continuous surface together with an upper inclined face of the second wing member 6L (6R). The wing members 5L and 6L can be moved vertically by a drive mechanism (not shown) in synchronization with the wing members 5R and 6R, so that the height level of the wing members 5L and 6L (5R and 6R) can be adjusted to make the sheet P slightly curved. When the sheet P is slightly curved, the sheet P hardly sags down loosely and hardly waves during its ejection. Therefore, an adequate curvature for the sheet P can be variably formed by the wing members 5L, 5R, 6L and 6R according to a size of the sheet P.

In the present embodiment, the ejection unit 10 is provided on the sheet set dividing unit 1 to set the ejection position of the sheet P precisely. However, the ejection unit 10 including the same configuration as explained above may be provided on the image forming apparatus to eject sheets P sequentially from the image forming apparatus to the sheet set dividing unit 1.

(Tray Elevating Mechanism 20)

In the tray elevating mechanism 20, the sheet tray 21 is disposed horizontally between the rear panels 2 of the sheet set dividing unit 1 and a front panel 3 distanced from the rear panels 2. Its drive mechanism (not shown) for elevating the sheet tray 21 is disposed on a right side of the sheet tray 21. The sheet tray 21 includes a front end 21*a* on a downstream side along the sheet ejection direction U, a rear end 21*b* on an upstream side along the sheet ejection direction U, a left-side end 21*c* and a right-side end (not shown) parallel to the left-side end 21*c*, and has a rectangular shape in its plan view.

In addition, the sheet tray 21 further includes a bottom center stem 21*p* and bottom ribs 21*q* and 21*r*. The bottom ribs

21*q* are aligned on the left side, and each of them extends from the left side toward the bottom center stem 21*p*. The bottom ribs 21*r* are aligned on the right side, and each of them extends from the right side toward the bottom center stem 21*p*. The bottom center stem 21*p* is disposed at a center between the left-side end 21*c* and the right-side end along the sheet ejection direction U, and has a flat upper surface 21*e*. Each of the bottom ribs 21*q* has an inclined upper surface 21*f* that is made gradually higher toward the left-side end 21*c*. Each of the bottom ribs 21*r* has an inclined upper surface 21*g* that is made gradually higher toward the right-side end. By the inclined upper surfaces 21*f* and 21*g*, the above-explained curvature is formed on the sheets P stacked on the sheet tray 21.

About four thousand of sheets P having an identical size such as A3 and A4 can be stacked on the sheet tray 21 (on the upper surfaces 21*e*, 21*f* and 21*g*). Therefore, a movable vertical range of the sheet tray 21 is set to about 400 to 500 mm.

In addition, a pair of inner vertical brackets 22 and 23 is attached at the right side of the sheet tray 21 to form a distance therebetween. Further, a pair of outer vertical brackets 22B and 23B is vertically provided outside the pair of the inner vertical brackets 22 and 23. The pair of outer vertical brackets 22B and 23B is also attached to the right side of the sheet tray 21. Two reinforcement rods 24 are provided between the pair of outer vertical brackets 22B and 23B (lower one is not shown in FIG. 1, but shown in FIG. 2). The reinforcement rods 24 penetrate the inner vertical brackets 22 and 23. Furthermore, a pair of rack members 28 is vertically provided on the right side of the pair of the outer vertical brackets 22B and 23B.

Furthermore, as shown in FIG. 1, a stepping motor 25 is attached to the outer vertical bracket 23B on the rear side, and the rotational output of the stepping motor 25 is transmitted to a gear 27 fixed at one end of a shaft 26 via a gear set (not shown). The shaft 26 is rotatably supported by the inner vertical brackets 22 and 23, and another gear 27 (see FIG. 2) is also fixed at another end of the shaft 26. The gears 27 fixed at the both ends of the shaft 26 are meshed with rack gears formed on the rack members 28, respectively. When the shaft 26 is rotated by the stepping motor 25, the gears 27 meshing with the rack gears on the rack members 28 vertically shift the outer vertical brackets 22B and 23B and the inner vertical brackets 22 and 23. As a result, the sheet tray 21 is vertically shifted integrally with the outer vertical brackets 22B and 23B and the inner vertical brackets 22 and 23.

As shown in FIG. 2, two pairs of a light emitter 29*a* and a light receiver 29*b* composing an optical sensor 29 for detecting a height level of the stacked sheets P are attached to the rear panel 2 and the front panel 3 of the sheet set dividing unit 1, respectively. Each pair of the light emitter 29*a* and the light receiver 29*b* are faced to each other, but distanced from each other to interpose the stacked sheets P therebetween. One of the pairs detects a height level of the upper surface 21*e* of the sheet tray 21 (the bottom center stem 21*p*), and another of the pairs detects a height level of the uppermost sheet P of the stacked sheets P.

While the sheets P are sequentially ejected from the ejection unit 10 (or supplied from the image forming apparatus) and then drop off onto the sheet tray 21, the controller 100 controls the stepping motor 25 to shift the height level of the sheet tray 21 based on the detection results of the optical sensors 29 so that a sheet drop height H (see FIG. 2) between a sheet ejection height level and the height level of the upper surface 21*e* (when no sheets P are stacked) or the height level of the uppermost sheet P is kept constant. Since the sheet drop height H is kept constant, the sheets P ejected from the ejection unit 10 (or supplied from the image forming apparatus) can keep its adequate attitude while dropping off, and can be stacked on the sheet tray 21 with its adequate attitude. Note that an optical sensor (not shown) for detecting that the sheet tray 21 is shifted downward to its lowermost position is also disposed at a lower portion of the pair of rack members 28.

(Laterally-Restricting Plates 31 and 32, and Laterally-Restricting Plate Shifting Mechanism 30)

As shown in FIGS. 1 to 3B, in the sheet ejection device 8, the laterally-restricting plates 31 and 32 are vertically disposed on the left and right sides of the sheet tray 21, and distanced from each other with interposing the sheet tray 21 therebetween. In addition, the laterally-restricting plate shifting mechanism 30 is disposed above the laterally-restricting plates 31 and 32 to shift the laterally-restricting plates 31 and 32 laterally according to the size (lateral width) of the stacked sheets P.

Since the laterally-restricting plates 31 and 32 have symmetrical shapes to each other, only the laterally-restricting plate 32 will be explained hereinafter as a representative of them, and explanations for the laterally-restricting plate 31 will be omitted.

The laterally-restricting plate 32 includes a frame 35. In the frame 35, plural walls 32*a* to 32*d* are extended vertically, and each of the walls 32*a* to 32*d* integrally connects an upper bar with a middle bar of the frame 35. A window W is formed between each adjacent pair of the walls 32*a* to 32*d*. In the frame 35, feet F are integrally extended downward from the center bar, and the feet F are almost associated with the walls 32*a* to 32*d*, respectively. Each width of the feet F along the sheet ejection direction U and a distance between each adjacent pair of the feet F are set so as to the feet F are located in some interspaces between the bottom ribs 21*r* on the sheet tray 21. When the laterally-restricting plate 32 is shifted laterally by the laterally-restricting plate shifting mechanism 30, the feet F laterally shifted in the some interspaces between the bottom ribs 21*r*.

On inner surfaces of some of the feet F, vertical ribs La and Lb are formed. In the present embodiment, the ribs La and Lb are formed on two of the feet F disposed on a near side to the ejection unit 10 (on an upstream side along the sheet ejection direction U). The ribs La and Lb are vertically extended from the foot F to an uppermost edge of the frame 35 through the walls 32*a* and 32*b*. No ribs are formed on inner surfaces of the walls 32*c* and 32*d* on a far side from the ejection unit 10 (on a downstream side along the sheet ejection direction U) and the foot F under the walls 32*c* and 32*d*, but the walls 32*c* and 32*d* and the foot F under the walls 32*c* and 32*d* forms a flat surface S. The flat surface S and ridges Lt (see FIG. 3B) of the ribs La and Lb are on a single plane. Here, the ribs La and Lb are formed to have a predetermined distance to interpose the window W therebetween. Both of the ribs La and Lb are located on the upstream side from the center of the laterally-restricting plate 32 along the sheet ejection direction U. In addition, the ribs La and Lb are "vertically" extended as explained above, but the term "vertically" includes a minute or slight inclination that does not prevent the sheet(s) P from dropping off onto the sheet tray 21 while its lateral edge PE (see FIG. 3B) is being contacted with the ribs La and Lb.

Figure 3A:
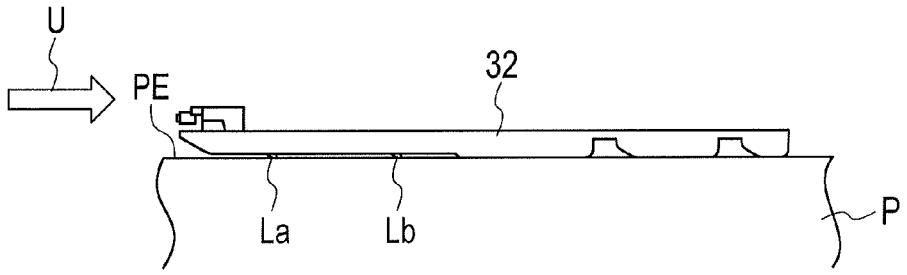
FIG. 3A is an enlarged plan view showing a state where a sheet contacts with a laterally-restricting plate in the sheet ejection device.
Figure 3B:
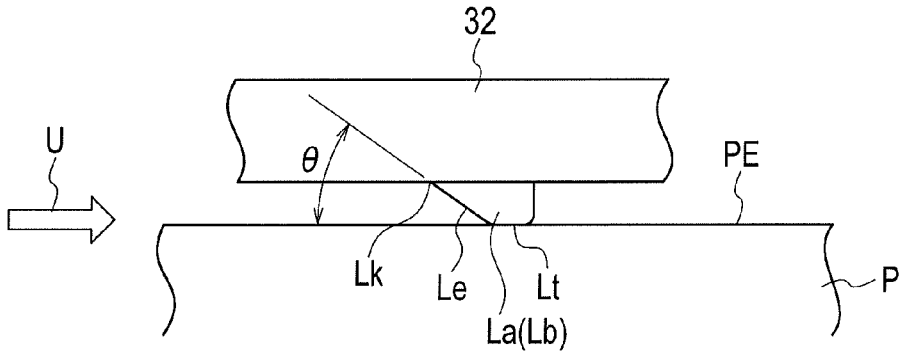
FIG. 3B is a further enlarged plan view showing the above state.

As shown in FIG. 3B, each of the ribs La and Lb has an almost trapezoid cross-sectional shape in its plan view. Specifically, each upstream surface Le of the ribs La and Lb is inclined by an angle θ to the lateral edge PE of the sheet P (to the sheet ejection direction U). Therefore, the upstream surface Le is formed as a gentle slope between an upstream edge Lk of the rib La (Lb) and the ridge Lt. Here, the gentle angle θ that forms the upstream surface Le as a gentle slope is an angle that can absorb an impact between the rib La (Lb) and the lateral edge PE of the ejected sheet P and can make the behavior of the sheet P stable to avoid the sheet P being damaged.

In addition, some of the feet F include extension members B at their lower ends, respectively (see back face of the laterally-restricting plate 31 on the left in FIG. 1). Each of the extension members B can slide vertically, and can swing laterally outward. When the sheet tray 21 is shifted downward, the lower ends of the extension members B are separated away from the sheet tray 21. However, the pair of laterally-restricting plates 31 and 32 always covers the range of the above-explained sheet drop height H (see FIG. 2).

On the other hand, the laterally-restricting plate shifting mechanism 30 is attached to a top panel (not shown) disposed above the sheet set dividing unit 1 so as to cover the sheet set dividing unit 1. Namely, a first motor 34 is attached to a first motor bracket 33R, and the first motor bracket 33R is fixed to the top panel. Note that the first motor 34 can be rotated forwardly and reversely.

The rotation of the first motor 34 is transmitted to a first timing pulley (not shown) fixed on an output shaft of the first motor 34. Further, a first timing belt 38 is wound around the first timing pulley and a second timing pulley 37 rotatably attached to a bracket 33L paired with the above-mentioned motor bracket 33R. The bracket 33L is also attached to the top panel. Two guide shafts 39 and 40 are disposed parallel to the extended first timing belt 38 with interposing the first timing belt 38 therebetween.

A first hanger 41 is fixed with the laterally-restricting plate 31 on the left, and a second hanger 42 is also fixed with the laterally-restricting plate 32 on the right. The first hanger 41 is slidably coupled with the guide shafts 39 and 40. The second hanger 42 is also slidably coupled with the guide shafts 39 and 40. The first hanger 41 is fixedly connected with a rear-side path of the first timing belt 38 near the laterally-restricting plate 31. The second hanger 42 is fixedly connected with a front-side path of the first timing belt 38 near the laterally-restricting plate 32.

When the first timing belt 38 is driven forwardly by driving the first motor 34 forwardly, the first and second hangers 41 and 42 are moved inward toward each other. Therefore, the laterally-restricting plates 31 and 32 are shifted toward each other to narrow the lateral distance therebetween. On the other hand, when the first timing belt 38 is driven reversely by driving the first motor 34 reversely, the first and second hangers 41 and 42 are distanced away from each other. Therefore, the laterally-restricting plates 31 and 32 are distanced from each other to widen the lateral distance therebetween. In this manner, the lateral distance between the laterally-restricting plates 31 and 32 can be adjusted according to the size (lateral width) of the stacked sheets P to restrict the stacked sheets P laterally.

(Offset Guide Plate Shifting Mechanism 50)

The offset guide plate shifting mechanism 50 configures one of featured portions in the present embodiment. The offset guide plate shifting mechanism 50 is unitized and attached to the uppermost rear panel 2 just beneath the ejection unit 10 (or the image forming apparatus) so that the sheets P sequentially ejected from the ejection unit 10 (or the image forming apparatus) can drop off onto the sheet tray 21.

Figure 4A:
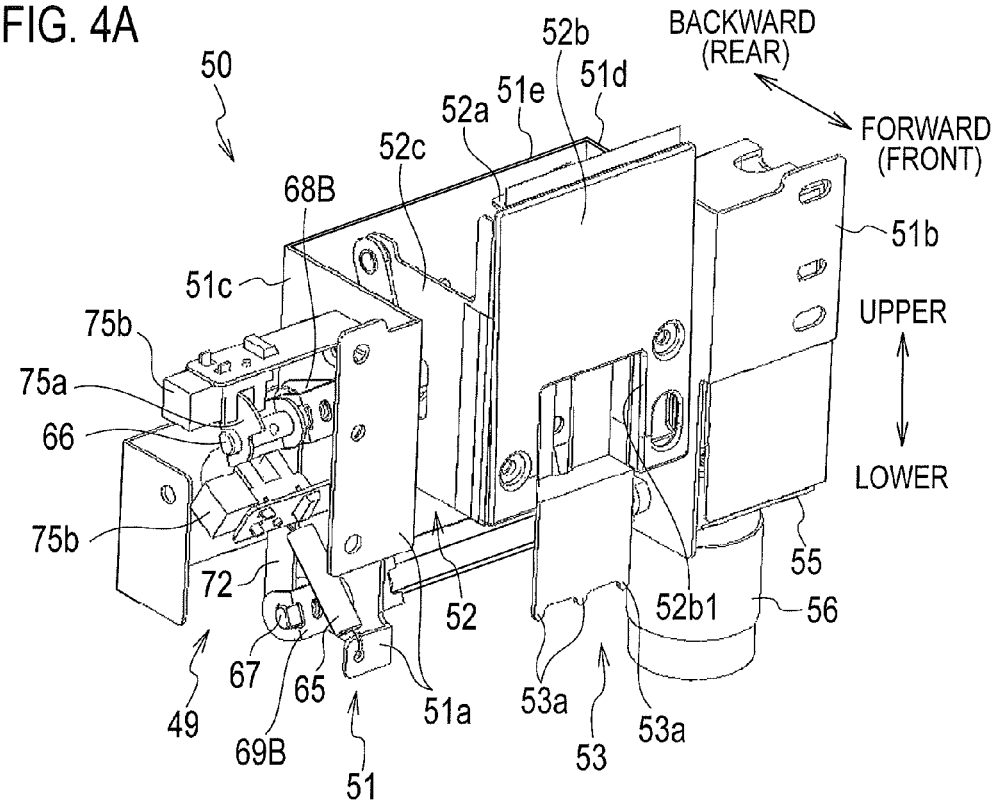
FIG. 4A is an enlarged cross-sectional view showing an offset guide plate shifting mechanism in the sheet ejection device in a state where an offset guide plate is set at its waiting position.
Figure 4B:
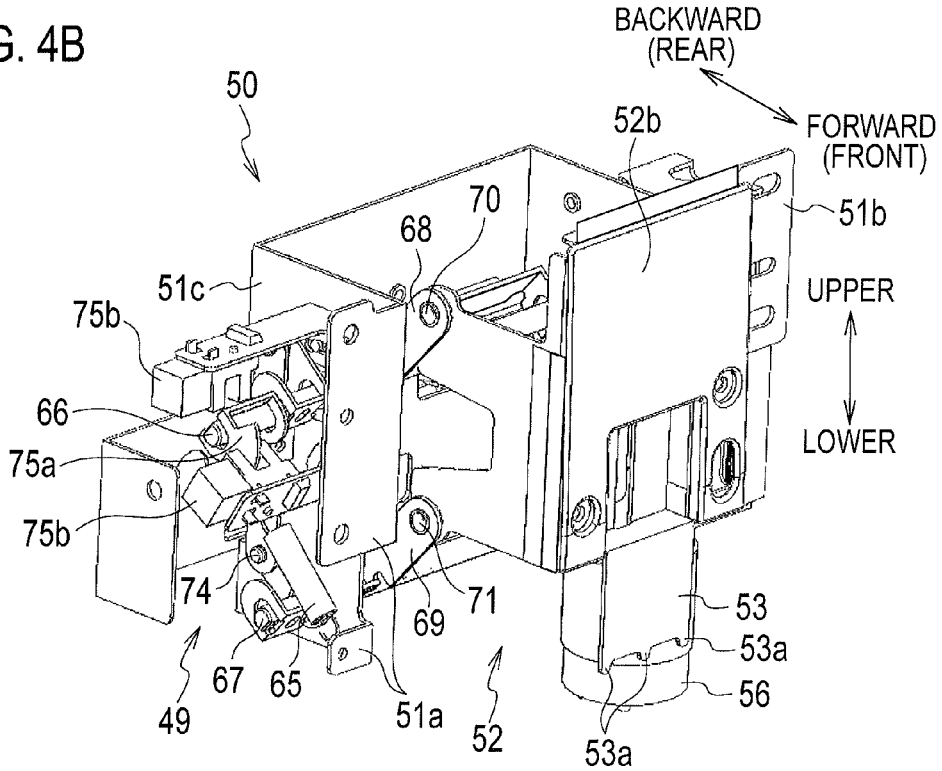
FIG. 4B is an enlarged cross-sectional view showing the offset guide plate shifting mechanism in a state where the offset guide plate is set at its offset position.

Hereinafter, the offset guide plate shifting mechanism 50 will be explained with reference to FIGS. 4A to 5B. As shown in FIGS. 4A and 4B, a first bracket 51 as a base member of the offset guide plate shifting mechanism 50 is made of a sheet metal to include a pair of front plates 51*a* and 51*b* laterally distanced from each other and vertically fixed to the uppermost rear panel 2 (see FIGS. 1 and 2), a pair of side plates 51*c* and 51*d* extended rearward from the front plates 51*a* and 51*b*, respectively, and a back plate 51*e* connecting the pair of side plates 51*c* and 51*d*. In addition, the above-mentioned offset guide plate 52 is disposed in an inner space surrounded by the pair of the side plates 51*c* and 51*d* and the back plate 51*e*.

The offset guide plate 52 includes a top plate 52*a* having a narrow width, a front guide plate 52*b* for restricting trailing edges of the stacked sheets P on the sheet tray 21 to set a set(s) of the stacked sheets P off, and a left-side plates 52*c* extended rearward from the left-side edge of the front guide plate 52*b*. In addition, a lower center portion of the front guide plate 52*b* is cutout to form a cutout 52*b*1. The above-mentioned first sheet aligning plate 53 made of a sheet metal is held in the cutout 52*b*1. The first sheet aligning plate 53 is weighed down with its own weight to extend just behind the rear end 21*b* of the sheet tray 21, or to contact its lower end with the uppermost sheet P of the stacked sheets P on the sheet tray 21

The first sheet aligning plate 53 is configured to align the trailing edges of the stacked sheets P on a front face of the front guide plate 52*b*. Rounded protrusions 53*a* are formed at both lateral ends and the center of the lower edge of the first sheet aligning plate 53, so that the first sheet aligning plate 53 can be softly contacted with the uppermost sheet P of the stacked sheets P to restrict a trailing edge of a sheet P to be stacked next together with the front guide plate 52*b*. Therefore, no gap is formed between the offset guide plate 52 and the uppermost sheet P when the first sheet aligning plate 53 contacts with the upper most sheet P of the stacked sheets P to divide the stacked sheets P into plural sets as explained later in detail, so that it become possible to restrict the trailing edge of the sheet P to be stacked next, and surfaces of the sheets P never be damaged.

In addition, a tension spring 65 is set between a lower portion of the front late 51*a* of the first bracket 51 and an operation support unit 49 disposed beside the side plates 51*c* as explained later in detail. Further, a drive motor 56 that can be rotated forwardly and reversely is attached to a bottom of a motor bracket 55, and the offset guide plate 52 is shifted by the drive motor 56. Furthermore, the side plate 51*c* of the first bracket 51 and after-explained rotational shafts 66 and 67 are linked by after-explained upper and lower link members 68 and 89 and a link plate 72. By this link mechanism, the offset guide plate 52 can be shifted, integrally with the first sheet aligning plate 53, almost along the sheet ejection direction U (also shifted downward).

Figure 5B:
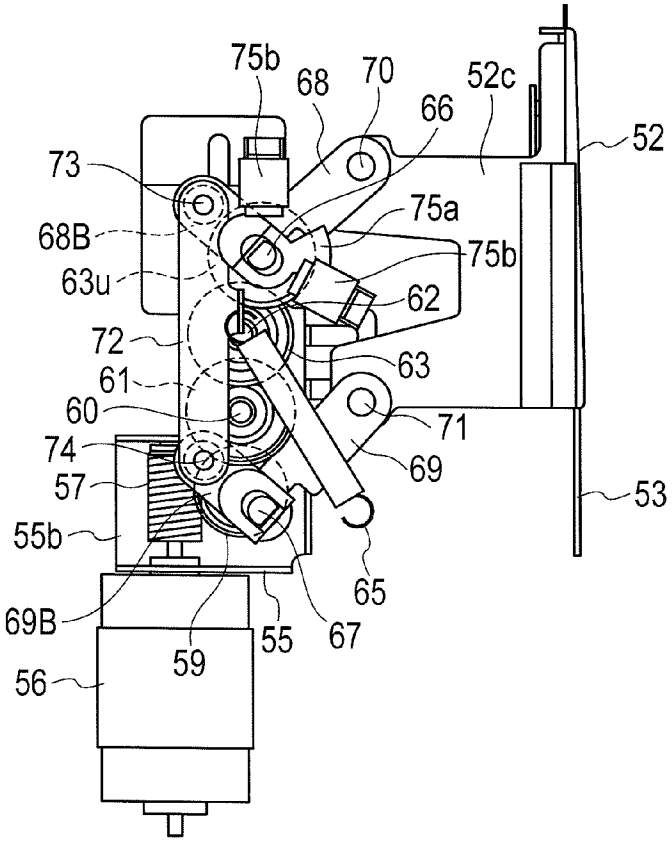
FIG. 5B is an enlarged side view showing the offset guide plate shifting mechanism in the state where the offset guide plate is set at the offset position.
Figure 5A:
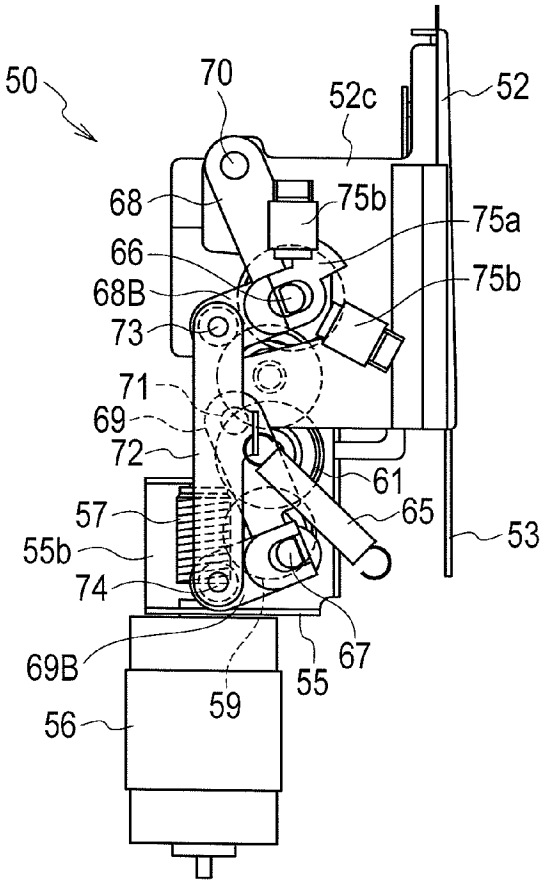
FIG. 5A is an enlarged side view showing the offset guide plate shifting mechanism in the state where the offset guide plate is set at the waiting position.

Specifically, as shown in FIGS. 5A and 5B, a worm 57 is attached to an output shaft of the drive motor 56, and meshes with a worm wheel 59 attached to a shaft (not shown) rotatably supported by a side plate 55*b* of the motor bracket 55. The worm wheel 59 further meshes with a gear 61 whose shaft 60 is rotatably supported by the side plate 55*b*. The gear 61 further meshes with a gear 63 rotatably about its shaft 62. The gear 63 meshes with a gear 63*u* fixed with the upper rotational shaft 66. The upper rotational shaft 66 and the lower rotational shaft 67 are provided rotatably on the first bracket 51 to have a distance vertically therebetween, and each of them penetrates the side plate 51*c* of the first bracket 51.

Between the side plates 51*c* of the first bracket 51 and the left-side plates 52*c* of the offset guide plate 52, one end of the above-mentioned link member 68 is fixed with the upper rotational shaft 66. Another end of the link member 68 is pivotally attached to a pivot point 70 at an upper corner of the left-side plates 52*c*. Similarly, one end of the above-mentioned link member 69 is fixed with the lower rotational shaft 67. Another end of the link member 69 is pivotally attached to a pivot point 71 at a lower corner of the left-side plates 52*c*. An upper short link member 68B is fixed with the upper rotational shaft 66 outside the side plate 51*c*. Similarly, a lower short link member 69B is fixed with the lower rotational shaft 67 outside the side plates 51*c*. The above-mentioned link plate 72 links ends of the short link members 68B and 69B at pivot points 73 and 74, respectively, to synchronize rotational angles of the rotational shafts 66 and 67.

Therefore, when the upper rotational shaft 66 is rotated by the drive motor 56 via the gears 57, 59, 61, 63 and 63*u*, the lower rotational shaft 67 is passively rotated by the links 68B, 69B and 72. In addition, when the rotational shafts 66 and 67 are synchronously rotated forwardly (clockwise in FIGS. 5A and 5B), the link members 68 and 69 are swung to shift the offset guide plate 52 almost along the sheet ejection direction U. On the other hand, the offset guide plate 52 is retracted when the rotational shafts 66 and 67 are synchronously rotated reversely (counter-clockwise in FIGS. 5A and 5B). Note that the tension spring 65 absorbs rattles of the above-explained link mechanism. Further, a shading plate 75*a* is fixed to the upper rotational shaft 66 and a pair of optical sensors 75*b* are attached to the side plate 51*c* of the first bracket 51 to detect the rotational position of the rotational shaft 66 (i.e. the shifted position of the offset guide plate 52).

According to the above-explained link mechanism, a maximum shift stroke of the offset guide plate 52 along the sheet ejection direction U is almost 30 mm, and a vertical shift stroke is almost 10 mm. Therefore, when dividing the sheets P into plural sets, the offset OS (see FIGS. 9A to 9J) of the trailing edges of the sheets P is set to ±30 mm that is equivalent to the shift stroke of the offset guide plate 52 along the sheet ejection direction U. In addition, a maximum vertical stroke of the first sheet aligning plate 53 is set to 10 mm (or larger) that is equivalent to the vertical shift stroke of the offset guide plate 52.

Namely, in the above-explained offset guide plate shifting mechanism 50, the offset guide plate 52 and the first sheet aligning plate 53 restrict the trailing edges of the sheets P according to the offset OS regardless of the size (length along the sheet ejection direction U) of the sheets P. Therefore, the offset guide plate shifting mechanism 50 can reduce costs by integrally shifting the offset guide plate 52 and the first sheet aligning plate 53 by the predetermined offset OS when dividing the sheets P into each set.

(End Plate Shifting Mechanism 80)

The end plate shifting mechanism 80 also configures one of featured portions in the present embodiment. The end plate shifting mechanism 80 is unitized and provided on a side of the front end 21*a* of the sheet tray 21. Hereinafter, the end plate shifting mechanism 80 will be explained with reference to FIGS. 6 to 7B. As shown in FIG. 6, the end plate shifting mechanism 80 includes a second bracket 81 made of a sheet metal, and the above-mentioned end plate 82 attached to the second bracket 81 vertically. The end plate 82 is faced to the offset guide plate 52 to have a distance equivalent to the length of the sheets P along the sheet ejection direction U. The second bracket 81 and the end plate 82 can be integrally shifted along the sheet ejection direction U according to the length of the sheets P.

As explained above, the end plate 82 can be shifted along the sheet ejection direction U, but the end plate 82 cannot be shifted vertically. Since the sheet tray 21 is elevated according to the number of the stacked sheets P when dividing the sheets P into plural sets, the end plate 82 is kept at a fixed height level higher than the upper surface 21*e* of the sheet tray 21. The end plate shifting mechanism 80 (the shifting mechanism for shifting the second bracket 81 and the end plate 82 integrally) is attached to the top panel (not shown) disposed above the sheet set dividing unit 1 so as to cover the sheet set dividing unit 1. Namely, a second motor 84 is attached to a second motor bracket 83, and the second motor bracket 83 is fixed to the top panel. Note that the second motor 84 can be rotated forwardly and reversely.

The rotation of the second motor 84 is transmitted to a third timing pulley 86 fixed on an output shaft of the second motor 84. Further, a second timing belt 88 is wound around the third timing pulley 86 and a fourth timing pulley 87 rotatably attached to the upper portion of the uppermost rear panel 2. Two guide shafts 89 and 90 are disposed parallel to the extended second timing belt 88 with interposing the second timing belt 88 therebetween.

A third hanger 91 (see FIG. 1) is fixed with the second bracket 81 (see FIG. 6). The third hanger 91 is slidably coupled with the guide shafts 89 and 90, similarly to the first hanger 41 (the second hanger 42) and the guide shafts 39 and 40 in the laterally-restricting plate shifting mechanism 30. The third hanger 91 is fixedly connected with one of left-side and right-side paths of the second timing belt 88.

When the second timing belt 88 is driven forwardly by driving the second motor 84 forwardly, the third hanger 91 is moved toward the offset guide plate 52. Therefore, the second bracket 81 and the end plate 82 are integrally shifted to set the sheets P off backwardly. On the other hand, when the second timing belt 88 is driven reversely by driving the second motor 84 reversely, the third hanger 91 is distanced away from the offset guide plate 52. Therefore, the second bracket 81 and the end plate 82 are shifted to set the sheets P off forwardly. In this manner, the offset OS for the sheets P can be set forwardly (+) or reversely (−) by restricting leading edges of the stacked sheets P.

As shown in FIG. 6, a second bracket 81 as a base member of the end plate shifting mechanism 80 is made of a sheet metal to include a top plate 81*a* fixed with the above-mentioned third hanger 91, a front plate 81*b* extended vertically downward from the top plate 81*a*, and a left-side plate 81*c* extended forward from the left side edge of the front plate 81*b*. The end plate 82 is fixed onto the rear face of the front plate 81*b* vertically to face to the offset guide plate 52 with interposing the sheet tray 21. An electromagnetic solenoid (i.e. the above-mentioned upward shifting mechanism) 93 for shifting the second sheet aligning plate 97 upward is attached to the front face of the front plate 81*b*. A movable iron core 93*a* of the electromagnetic solenoid 93 is extended downward. A lower end of the movable iron core 93*a* is pivotally attached to a movable pivot point 94*a* on a lever 95. In addition, a base end of the lever 95 is pivotally attached to a stationary pivot point 94*b* on the front plate 81*b*. When the movable pivot point 94*a* is lifted up by the electromagnetic solenoid 93 via the movable iron core 93*a*, the lever 95 is swung upward about the stationary pivot point 94*b*.

In addition, the second sheet aligning plate 97 made of a sheet metal is slidably coupled with the second bracket 81 on the front side of the second bracket 81. An upper end of the second sheet aligning plate 97 is hooked with a roller 96*a* rotatably attached to another end of the lever 95 via a rotational axis 96*b*. The second sheet aligning plate 97 includes a pair of sheet aligning arms 97*p* made of resin at its lower ends, so that the second sheet aligning plate 97 can be softly contacted with the uppermost sheet P of the stacked sheets P to restrict a leading edge of a sheet P to be stacked next. Further, the second sheet aligning plate 97 includes a shading plate 97*a* at its upper end and an optical sensor 98 is attached to the front plate 81*b* of the second bracket 81 to detect the vertical position of the second sheet aligning plate 97.

Figure 7B:
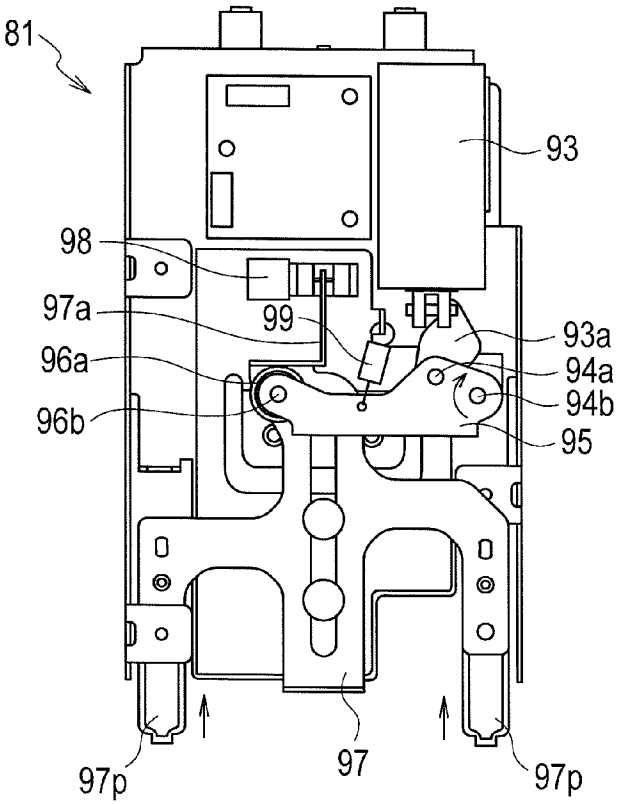
FIG. 7B is a rear view showing the end plate shifting mechanism in a state where the second sheet aligning plate is lifted up.
Figure 7A:
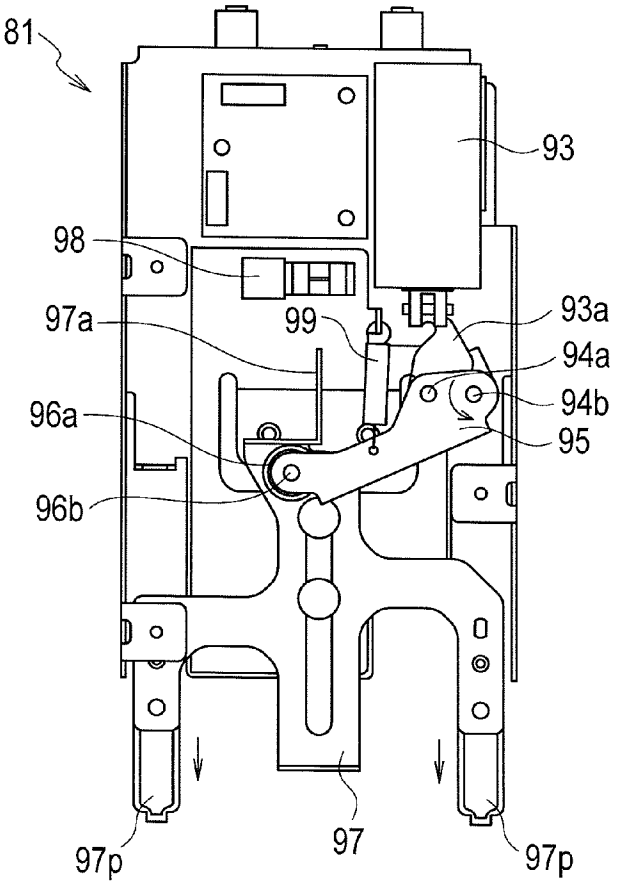
FIG. 7A is a rear view showing the end plate shifting mechanism in a state where a second sheet aligning plate is weighed down.

When the electromagnetic solenoid 93 is de-energized as shown in FIG. 7A, the second sheet aligning plate 97 is weighed down with its own weight to contact the sheet aligning arms 97*p* with the upper surface 21*e* of the sheet tray 21 on which no sheets P are stacked or with the uppermost sheet P of the stacked sheets P on the sheet tray 21. Here, the lever 95 is also swung downward due to its own weight and the weight of the second sheet aligning plate 97. Therefore, no gap is formed between the second sheet aligning plate 97 (the sheet aligning arms 97*p*) and the uppermost sheet P when the second sheet aligning plate 97 contacts with the upper most sheet P of the stacked sheets P to divide the stacked sheets P into plural sets as explained later in detail, so that it become possible to restrict the leading edge of the sheet P to be stacked next, and surfaces of the sheets P never be damaged.

On the other hand, when the electromagnetic solenoid 93 is energized to swing the lever 95 upward by the movable iron core 93*a* as shown in FIG. 7B, the second sheet aligning plate 97 is lifted up by the lever 95. Therefore, the second sheet aligning plate 97 (the sheet aligning arms 97*p*) is separated away from the uppermost sheet P. A vertical shift stroke of the second sheet aligning plate 97 is almost 10 mm similarly to that of the offset guide plate 52 (the first sheet aligning plate 53). Note that a tension spring 99 is provided to absorb rattles of the above-explained shifting mechanism.

Namely, in the above explained end plate shifting mechanism 80, the end plate 82 and the second sheet aligning plate 97 restrict the leading edges of the sheets P according to the above-explained offset OS and the size (length along the sheet ejection direction U) of the sheets P. Therefore, the end plate shifting mechanism 80 integrally shifts the end plate 82 and the second sheet aligning plate 97 by the second motor 84 by the predetermined offset OS when dividing the sheets P into each set. And the end plate shifting mechanism 80 shifts the second sheet aligning plate 97 upward by the energization of the electromagnetic solenoid 93, and shifts the second sheet aligning plate 97 downward by the de-energization of the electromagnetic solenoid 93.

In the present embodiment, the electromagnetic solenoid 93 is used as the upward shifting mechanism for shifting the second sheet aligning plate 97 upward. However, the upward shifting mechanism is not limited to the electromagnetic solenoid 93, and may have another mechanism as long as it can softly contact the second sheet aligning plate 97 with the uppermost sheet P of the stacked sheets P. For example, a piezo-stack actuator or a motor may be used as the upward shifting mechanism.

(Controller 100)

Figure 8:
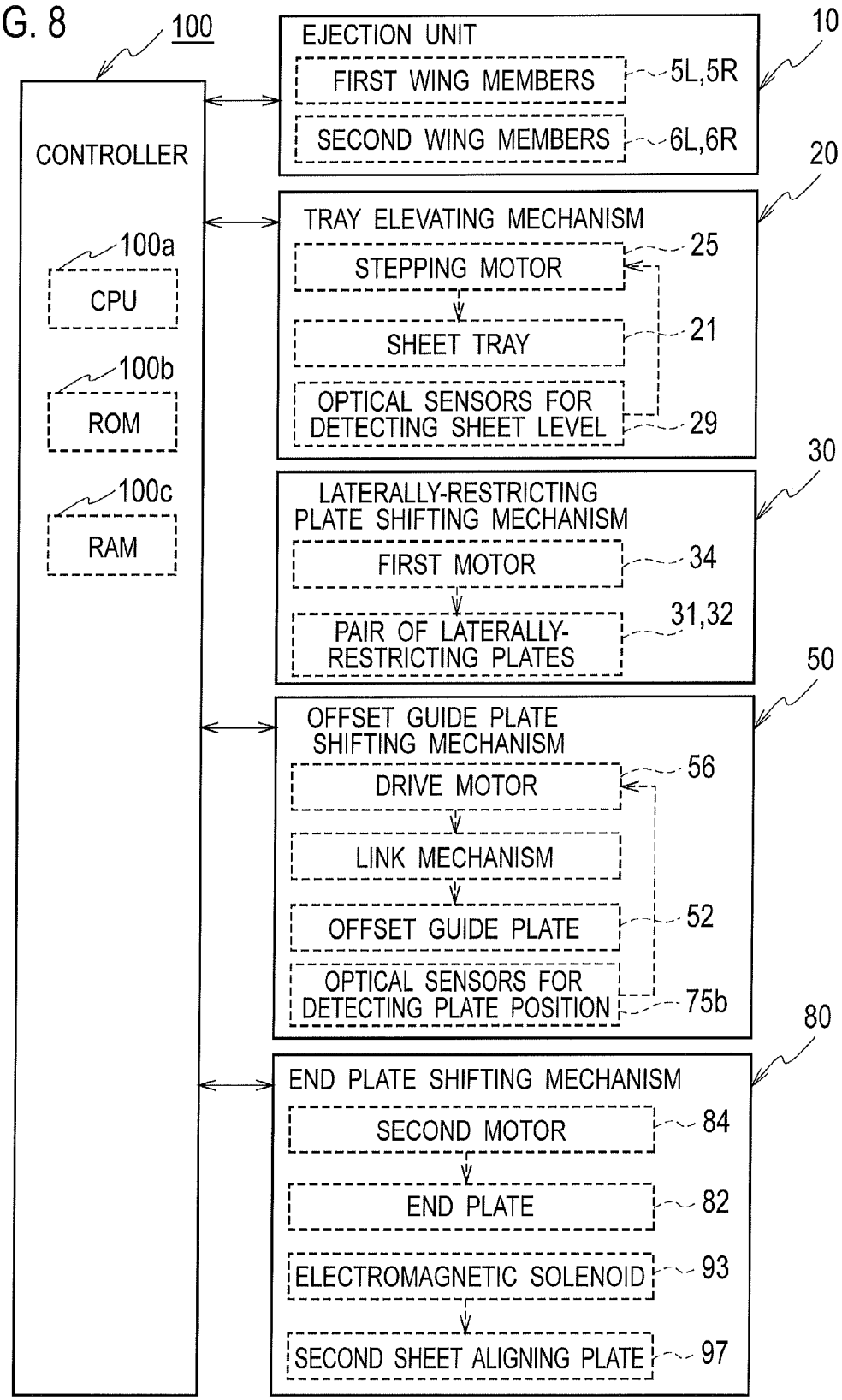
FIG. 8 is a block diagram of the sheet ejection device.

As shown in FIG. 8, the controller 100 includes, in its inside, a CPU 100*a* for executing arithmetic processings and judgment processings, a ROM 100*b* in which an operation program of the sheet set dividing unit 1 and so on are stored, and a RAM 100*c* for temporally storing variable information for the sheet set dividing unit 1. In addition, the controller 100 controls the ejection unit 10, the tray elevating mechanism 20, the laterally-restricting plate shifting mechanism 30, the offset guide plate shifting mechanism 50, and the end plate shifting mechanism 80.

(Operations for Dividing Sheets into Sets)

Hereinafter, operations for dividing the sheets P sequentially ejected from the ejection unit 10 (or the image forming apparatus) into plural sets on the sheet tray 21 will be explained step by step with reference to FIGS. 9A to 9J. Note that the optical sensors 29 for detecting a height level SL of the upper surface 21*e* of the sheet tray 21 on which no sheets P are stacked (FIG. 9A) or a height level SL of the uppermost sheet P of the stacked sheets P on the sheet tray 21 (FIGS. 9B to 9J) are shown only in FIGS. 9A and 9F. In stead, the height level SL is indicated by dashed-dotted lines in FIGS. 9B to 9E and 9G to 9J. Hereinafter, the height level SL is referred as a sheet level SL. In the present embodiment, the size (length along the sheet ejection direction U) of the sheets P stacked on the sheet tray 21 is only a single variety.

In addition, when dividing the sheets P sequentially ejected from the ejection unit 10 (or the image forming apparatus) into plural sets by setting sheet sets off alternately (forwardly and backwardly), the predetermined number of the sheets P in a single set may be set to a constant value for each set, or may be set differently (variously) for each set according to print jobs or the like. Further, when setting sheet sets off alternately (forwardly and backwardly), a first stacking position (backward offset position) and a second stacking position (forward offset position) can be set, and the two positions are set alternately.

Here, the first stacking position is a position where the offset guide plate 52 and the end plate 82 are set at their upstream (backward) positions (i.e. their waiting positions), respectively. In other words, when the offset guide plate 52 and the end plate 82 are set at their waiting position, the sheets P are stacked at the first stacking position (see FIGS. 9B and 9J). On the other hand, the second stacking position is a position where the offset guide plate 52 and the end plate 82 are set at their downstream (forward) positions (i.e. their offset positions), respectively. In other words, when the offset guide plate 52 and the end plate 82 are set at their offset position, the sheets P are stacked at the second stacking position (see FIG. 9F). The sheets P are stacked at the first stacking position during odd times of the sheet dividing operations, and the sheets P are stacked at the second stacking position during even times of the sheet dividing operations.

Figures 9A, 9B, 9C, 9D, 9E, 9F, 9G, 9H, 9I, 9J:
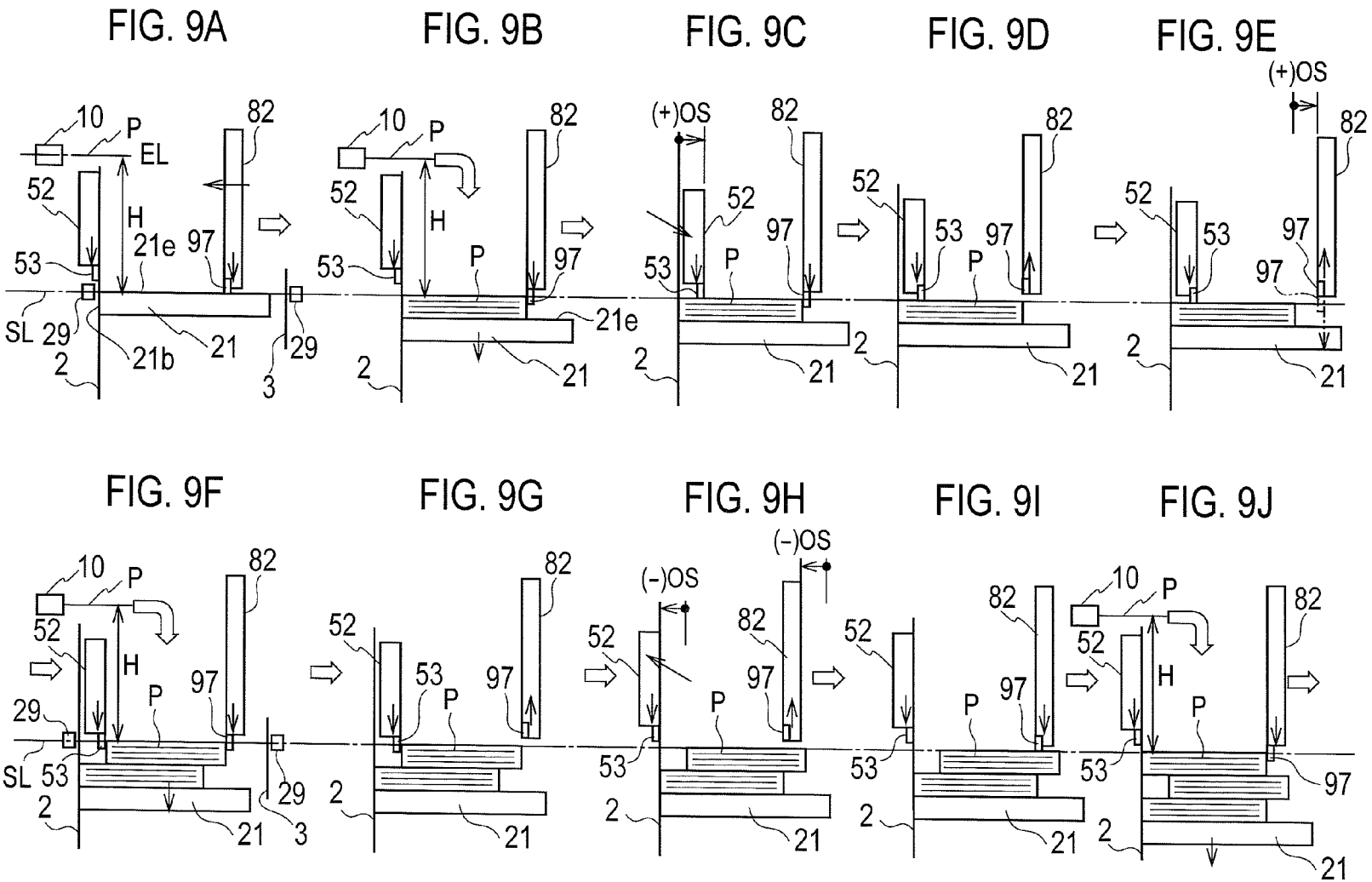
FIGS. 9A to 9J are side views schematically showing sheet dividing operations by the sheet ejection device.

As shown in FIG. 9A, the sheet tray 21 is set at its waiting position (the uppermost height level) for the sheet dividing operation at the first stacking position before the first sheet P is stacked on the sheet tray 21. The height level of the upper surface 21*e* of the sheet tray 21 is detected by the optical sensors 29, and thereby the height level of the sheet tray 21 is set by the tray elevating mechanism 20 so that the sheet drop height H (between a sheet ejection level EL and the sheet level SL) is kept constant.

In addition, the offset guide plate 52 provided on a side of the rear panels 2 is located at a height level higher than the upper surface 21*e* of the sheet tray 21. The offset guide plate 52 is slightly distanced from the rear end 21*b* of the sheet tray 21 and almost flat with the uppermost rear panel 2 to restrict the trailing edges of the sheets P for the first dividing operation of the sheets P. The first sheet aligning plate 53 attached to the lower portion of the offset guide plate 52 is weighed down with its own weight to restrict the trailing edges of the sheets P together with the offset guide plate 52.

Further, the end plate 82 provided on a side of the front panel is moved backward so that the distance between the end plate 82 and the rear panel 2 (i.e. the retracted offset guide plate 52) is made almost equivalent to (or slightly wider than) the length of the sheets P to be stacked on the sheet tray 21. Namely, the end plate 82 is set at a position associated with the size (length along the sheet ejection direction U) of the sheets P to be stacked on the sheet tray 21 to restrict the leading edges of the sheets P for the first dividing operation of the sheets P. Furthermore, the end plate 82 is located at a height level higher than the upper surface 21*e* of the sheet tray 21. The second sheet aligning plate 97 attached to the lower portion of the end plate 82 is weighed down with its own weight (the electromagnetic solenoid 93 is de-energized) and the sheet aligning arms 97*p* at the lower ends of the second sheet aligning plate 97 are softly contacted with the upper surface 21*e* to restrict the leading edges of the sheets P together with the end plate 82.

Subsequently, as shown in FIG. 9B, the offset guide plate 52, the first sheet aligning plate 53, the end plate 82 and the second sheet aligning plate 97 are set at the same positions as shown in FIG. 9A. Therefore, in the first sheet dividing operation, a sheet stacking position is set between the uppermost rear plate 2 (the offset guide plate 52 and the first sheet aligning plate 53 made almost flat with the uppermost rear panel 2) and the end plate 82 (the second sheet aligning plate 97) located at the position associated with the size (length along the sheet ejection direction U) of the sheets P. Namely, the sheets P are stacked at the first stacking position in the first sheet dividing operation (in odd times of sheet dividing operations).

The sheets P sequentially ejected from the ejection unit 10 (or the image forming apparatus) fall down between the rear panel 2 (the retracted offset guide plate 52) and the end plate 82, and thereby are sequentially stacked on the sheet tray 21. Here, the leading edges of the sheets P are aligned (restricted) by the second sheet aligning plate 97. The sheet level SL is continuously detected by the optical sensors 29, and the sheet tray 21 is shifted downward by the tray elevating mechanism 20 to keep the sheet drop height H constant. According to this downward shifting of the sheet tray 21, the second sheet aligning plate 97 becomes separated from the upper surface 21*e*. When the predetermined number of the sheets P are stacked on the sheet tray 21 as the first divided sheet set, the downward shifting of the sheet tray 21 is stopped and the first sheet dividing operation is finished.

Subsequently, as shown in FIG. 9C, the offset guide plate 52 is shifted forward and downward by the offset guide plate shifting mechanism 50 for the second sheet dividing operation while the second sheet aligning plate 97 is kept contacted with the leading edges of the sheets P stacked in the first sheet dividing operation. The offset guide plate 52 is shifted forward by the offset OS along the sheet ejection direction U. By keeping the second sheet aligning plate 97 contacted with the leading edges of the sheets P, the sheets P stacked in the first sheet dividing operation are restricted so as not to get misaligned forward. Note that the sheet tray 21 is being stopped still at the position where it has been stopped when the first sheet dividing operation is finished.

The offset guide plate 52 is protruded from the uppermost rear panel 2, and stopped in a state where the lower end of the first sheet aligning plate 53 is contacted with the uppermost sheet P of the first divided sheet set. The offset OS of the offset guide plate 52 (the first sheet aligning plate 53) for the second sheet dividing operation is set to +30 mm. Here, the first sheet aligning plate 53 is softly contacted with the uppermost sheet P at a forward position from the trailing edges of the sheets P of the first divided sheet set, but the uppermost sheet P never got misaligned forward because of the restriction by the second sheet aligning plate 97.

Subsequently, as shown in FIG. 9D, the second sheet aligning plate 97 is temporally lifted up for the second sheet dividing operation. Here, the sheet tray 21 is being stopped still at the position where it has been stopped when the first sheet dividing operation is finished. In addition, the offset guide plate 52 and the first sheet aligning plate 53 are being stopped still at the positions shown in FIG. 9C. Although the end plate 82 is also being stopped still at the position shown in FIG. 9C, the second sheet aligning plate 97 is temporally lifted up by energizing the electromagnetic solenoid 93 to be separated from the sheets P of the first divided sheet set.

Subsequently, as shown in FIG. 9E, the end plate 82 is shifted forward by the end plate shifting mechanism 80 for the second sheet dividing operation while the second sheet aligning plate 97 is kept lifted up. The second sheet aligning plate 97 is weighed down with its own weight by de-energizing the electromagnetic solenoid 93 after the end plate 82 has been shifted forward by the offset OS as shown by dashed-two-dotted lines. Here, the sheet tray 21 is being stopped still at the position where it has been stopped when the first sheet dividing operation is finished. In addition, the offset guide plate 52 and the first sheet aligning plate 53 are being stopped still at the positions shown in FIGS. 9C and 9D.

The offset OS of the end plate 82 (the second sheet aligning plate 97) for the second sheet dividing operation is set to +30 mm, similarly to the offset OS of the offset guide plate 52 (the first sheet aligning plate 53). The second sheet aligning plate 97 is positioned forward from the leading edges of the sheets P of the first divided sheet set, and the lower ends of the sheet aligning arms 97*p* are positioned at a height level lower than the uppermost sheet P of the first divided sheet set but not contacted with the sheet tray 21.

Subsequently, as shown in FIG. 9F, the offset guide plate 52, the first sheet aligning plate 53, the end plate 82 and the second sheet aligning plate 97 are set at the same positions as shown in FIG. 9E. Therefore, in the second sheet dividing operation, a sheet stacking position is set between the offset guide plate 52 (the first sheet aligning plate 53) protruded from the uppermost rear panel 2 and the end plate 82 (the second sheet aligning plate 97) shifted forward. Namely, the sheets P are stacked at the second stacking position (in even times of sheet dividing operations).

The sheets P sequentially ejected from the ejection unit 10 (or the image forming apparatus) fall down between the offset guide plate 52 shifted forward and the end plate 82 shifted forward, and thereby are sequentially stacked on the first divided sheet set. The sheet level SL is continuously detected by the optical sensors 29, and the sheet tray 21 is shifted downward by the tray elevating mechanism 20 to keep the sheet drop height H constant. When the predetermined number of the sheets P are stacked on the first divided sheet set as the second divided sheet set, the downward shifting of the sheet tray 21 is stopped and the second sheet dividing operation is finished.

Subsequently, as shown in FIGS. 9G to 9J, the third sheet dividing operation is done. Since the third sheet dividing operation is almost the same as the first sheet dividing operation, it will be briefly explained hereinafter. As shown in FIG. 9G, the second sheet aligning plate 97 is temporally lifted up after the second sheet dividing operation. This process is different from the first sheet dividing operation. Subsequently, as shown in FIG. 9H, the offset guide plate 52 (the first sheet aligning plate 53) is shifted backward by the offset OS set to −30 mm, so that the offset guide plate 52 (the first sheet aligning plate 53) is reverted to its waiting position (the same position in the first sheet dividing position). The end plate 82 (the second sheet aligning plate 97) is also shifted backward by the offset OS set to −30 mm while the second sheet aligning plate 97 is temporally lifted up, so that the end plate 82 (the second sheet aligning plate 97) is reverted to the same position in the first sheet dividing position.

Subsequently, as shown in FIG. 9I, the second sheet aligning plate 97 is weighed down with its own weight (the electromagnetic solenoid 93 is de-energized) and the sheet aligning arms 97*p* at the lower ends of the second sheet aligning plate 97 are softly contacted with the uppermost sheet P of the second divided sheet set to restrict the leading edges of the sheets P together with the end plate 82. Subsequently, as shown in FIG. 9J, the third sheet dividing operation is made similarly to the first sheet dividing operation. In a case where the fourth sheet dividing operation is made, it is made similarly to the second sheet dividing operation. In these manners, by repeating the plural sheet dividing operations, the sheets P are divided into the plural set on the sheet tray 21 by shifting the offset guide plate 52 and the end plate 82 alternately (forwardly and backwardly).

(Advantages)

According to the present embodiment, a sheet(s) P ejected from the ejection unit 10 of the sheet ejection device 8 contacts with the ribs La and Lb on the laterally-restricting plate 32 (31) at its side edge(s) PE extending along the sheet ejection direction U as shown in FIG. 3. Therefore, an attitude of the sheet P can be corrected adequately while moving forward and dropping downward, and then stacked after its lateral position is aligned correctly. As a result, superior sheet ejection performance can be provided according to the sheet ejection device 8 without affected its environment such as humidity.

In addition, a drop speed of a sheet P while its side edge(s) PE is aligned by the ribs La and Lb becomes faster that that while the side edge(s) PE is aligned by the flat surface(s) S. Therefore, a drop speed of a trailing edge of the sheet P (on a side of the ribs La and Lb) becomes faster than a drop speed of a leading edge of the sheet P (on a side of the flat surface(s) S). As a result, the side edge(s) PE can be aligned stably on a side of the trailing edge (on a side of the ribs La and Lb), and the number of ejection sheets per unit time can be made larger because the next sheet ejection can be done earlier.

In addition, the flat surface(s) S is formed on an inner surface(s) of the laterally-restricting plate (side fence) 32 (31) so that the flat surfaces S and the ridges Lt of the ribs La and Lb are on a single plane. Therefore, the side edge(s) PE on the side of the leading edge contacts with the flat surface S, so that inclination of the leading edge of the sheet P (the orientation of the leading edge becomes unparallel to the sheet ejection direction U) can be prevented while preventing reduction of the number of ejection sheets per unit time.

Further, each of the ribs La and Lb has the upstream surface Le gently inclined to the side edge PE of the sheet P as shown in FIG. 3B. Specifically, the upstream surface Le is formed as a gentle slope between the upstream edge Lk and the ridge Lt, and is inclined by the gentle angle θ. Therefore, inclination of the leading edge of the sheet P (the orientation of the leading edge becomes unparallel to the sheet ejection direction U) can be prevented when the leading edge contacts with the ribs La and Lb. Here, the gentle angle θ is an angle that enables absorption of an impact of the leading edge of the sheet P on to the ribs La and Lb and avoidance of sheet damages to make behavior of the sheet P stable.

Furthermore, the ejection unit 10 can eject the sheets P while making them slightly curved to prevent them from sagging down loosely and waving, and can form an adequate curvature to various types of the sheets P. Therefore, the sheets P can be ejected after getting the adequate curvature according to the shapes, the positions and the number of the ribs La and Lb, Note that the ribs La and Lb are aligned on an upstream side as rib formed on the inner surfaces of the laterally-restricting plates 32 and 31 in the present embodiment. By forming at least one rib on an upstream side on each of the laterally-restricting plates (side fences) 32 and 31, behaviors of the sheets P can be corrected by the ribs and then the sheets P can be stacked while laterally aligned precisely.

The present invention is not limited to the above-mentioned embodiment, and it is possible to embody the present invention by modifying its components in a range that does not depart from the scope thereof. Further, it is possible to form various kinds of inventions by appropriately combining a plurality of components disclosed in the above-mentioned embodiment. For example, it may be possible to omit several components from all of the components shown in the above-mentioned embodiment.

The present application claims the benefit of a priority under 35 U.S.C §119 to Japanese Patent Application No. 2012-191107, filed on Aug. 31, 2012, the entire content of which is incorporated herein by reference.

What is claimed is:

1. A sheet ejection device comprising:

a sheet tray on which ejected sheets are stacked, the sheet tray having a central axis;

a pair of side fences for restricting positions of the ejected sheets along a lateral direction perpendicular to an ejection direction;

at least one rib is formed vertically on each inner side of the side fences, in a top view each rib has an inclined surface inclined in the ejection direction toward the central axis; and the ribs are configured to contact with side edges of each of the ejected sheets while the each of the ejected sheets falls down to the sheet tray to align each of the ejected sheets along the lateral direction.

2. The sheet ejection device according to claim 1, wherein each side fence includes an upstream side and a downstream side along the ejection direction, and for each side fence:

a flat surface is formed on the downstream side;

the rib is formed on the upstream side upstream of the flat surface;

the inclined surface defines an upstream surface of each rib; and the rib includes a ridge, the flat surface and the ridge being on a single plane.

3. The sheet ejection device according to claim 2, wherein each side fence has two of the ribs formed parallel to each other on the upstream side thereof.

4. The sheet ejection device according to claim 1, further comprising a side fence shifting mechanism that is configured to adjust a lateral distance between the pair of side fences.

5. The sheet ejection device according to claim 2, further comprising a tray elevating mechanism that is configured to shift the sheet tray vertically.

6. The sheet ejection device according to claim 5, further comprising at least one level sensor that detects a height level of an upper surface of the sheet tray on which no sheets are stacked or a height level of an uppermost sheet of the ejected sheets stacked on the sheet tray as a sheet level, and the tray elevating mechanism shifts the sheet tray vertically to keep the sheet level constant.

7. A sheet ejection device comprising:

a sheet tray on which ejected sheets are stacked;

a pair of side fences for restricting positions of the ejected sheets along a lateral direction perpendicular to an ejection direction, each side fence having an inner surface;

at least one rib is formed vertically on the inner surface of each side fence, in a top view each rib has an inclined surface inclined in the ejection direction;

each rib has longitudinal axis that is perpendicular to the ejection direction and to the lateral direction;

the ribs are configured to contact with side edges of each of the ejected sheets while each of the ejected sheets falls down to the sheet tray to align each of the ejected sheets along the lateral direction; and each side fence has two of the ribs formed parallel to each other on the upstream side thereof.

8. The sheet ejection device according to claim 7, wherein each side fence includes an upstream side and a downstream side along the ejection direction, and for each side fence:

a flat surface is formed on the downstream side;

the rib is formed on the upstream side upstream of the flat surface;

the inclined surface defines an upstream surface of each rib; and the rib includes a ridge, the flat surface and the ridge being on a single plane.

9. The sheet ejection device according to claim 7, further comprising a side fence shifting mechanism that is configured to adjust a lateral distance between the pair of side fences.

10. The sheet ejection device according to claim 8, further comprising a tray elevating mechanism that is configured to shift the sheet tray vertically.

11. The sheet ejection device according to claim 10, further comprising at least one level sensor that detects a height level of an upper surface of the sheet tray on which no sheets are stacked or a height level of an uppermost sheet of the ejected sheets stacked on the sheet tray as a sheet level, and the tray elevating mechanism shifts the sheet tray vertically to keep the sheet level constant.

* * * * *